United States Patent [19]

Pfister et al.

[11] Patent Number: 4,573,245

[45] Date of Patent: Mar. 4, 1986

[54] BRAKING SYSTEM FOR YARN BEAMING ASSEMBLIES

[75] Inventors: Jörg Pfister; Arnold Kuzmenko, both of Freiburg, Fed. Rep. of Germany

[73] Assignee: Rhodia AG, Freiburg, Fed. Rep. of Germany

[21] Appl. No.: 503,864

[22] Filed: Jun. 13, 1983

[30] Foreign Application Priority Data

Jul. 1, 1982 [DE] Fed. Rep. of Germany ..... 3224507

[51] Int. Cl.[4] ..... D02H 13/08; D02H 13/26

[52] U.S. Cl. ..... 28/187; 28/194

[58] Field of Search ..... 28/185, 186, 194, 187; 242/75.42

[56] References Cited

U.S. PATENT DOCUMENTS 2,924,869 2/1960 Klein et al. ..... 28/194
2,927,364 3/1960 Adams ..... 28/194 X
2,964,826 12/1960 Klein et al. ..... 28/185

FOREIGN PATENT DOCUMENTS 1330957 9/1973 United Kingdom ..... 28/185

*Primary Examiner*—Robert R. Mackey
*Attorney, Agent, or Firm*—Bucknam and Archer

[57] ABSTRACT

An apparatus for assembling warps of spun fibers and/or filament yarns present on yarn beams to form a warp present on a warp beam is described. This apparatus has a pneumatic pressure regulator (1), an electromagnetically operable pneumatic valve (2) downstream of the pressure regulator, a three-position rotary disk valve (3) downstream of the pneumatic valve, and pneumatically operable brake cylinders (4) of the yarn beam brakes (12) which are arranged downstream of the three-position rotary disk valve and connected in parallel with each other and a pneumatic by-pass limited in time so that asynchronous pneumatic braking of the yarn beams and of the warp beam during rapid braking is avoided. The by-pass serves to bridge the switching time of the three-position rotary disk valve (3). According to one embodiment, the control of the pneumatic valve (6) switchable with delay and of the pneumatic valves (7 and 8) occurs pneumatically. According to another embodiment, the control of the electric delay element (9) and of the pneumatic valves (10 and 11) occurs electrically.

3 Claims, 3 Drawing Figures

BRAKING SYSTEM FOR YARN BEAMING ASSEMBLIES

BACKGROUND OF THE INVENTION

1. Field of the Invention

The invention relates to an apparatus for assembling warps of spun fibers and/or filament yarns present in yarn beams to form a textile warp located in a warp beam. The apparatus comprises a pneumatic pressure regulator, an electromagnetically operable pneumatic valve downstream of the pressure regulator, a three-position rotary disk valve downstream of the pneumatic valve, and pneumatically operable yarn beam brake cylinders downstream of the three-position rotary disk valve and connected in parallel with it.

In known assembly systems the warp beam is driven, but the yarn beams are not driven. In the normal operation of the known assembly systems, in order to obtain a constant tension of the yarns between the yarn beams and the warp beam, the non-driven yarn beams are slightly decelerated, that is the available compressed air is reduced by means of a pneumatic pressure regulator to a predetermined lower desired value and is conducted by an electromagnetically operable pneumatic valve downstream of the pressure regulator to a three-position rotary disk valve which is arranged downstream of the pneumatic valve and thence to the yarn beam brake cylinders connected in parallel following the three-position rotary disk valve.

In case of rapid braking of the known assembly systems, caused by a disturbance, for example a thread rupture, the warp beam is braked very quickly, while the yarn beams are usually braked only with some delay.

For rapid braking, the electromagnetically operable pneumatic valve is reversed, so that the air stream coming from the pressure regulator is interrupted and the available compressed air at a higher pressure passes through this pneumatic valve to the following three-position rotary disk valve. However, if this rotary disk valve is closed on the inlet side, it takes a while for it to get into open position. In this case, the compressed air at a higher pressure reaches the brake cylinders of the yarn beam brakes with a delay.

2. Description of the Prior Art

For this reason, the braking of the yarn beams and of the warp beam is not synchronous. The result is that the yarn beams lag, especially if they are still quite full and, therefore, heavy. Due to this fact, the yarns first become very slack and strike against one another, leading to filament ruptures. Thereafter, the yarns are tensioned abruptly, because after the three-position rotary disk valve is switched, the compressed air at a higher pressure suddenly acts on the brake cylinders of the yarn beam brakes. The abrupt tensioning of the yarns may lead to yarn ruptures.

SUMMARY OF THE INVENTION

An object of the present invention is to provide an apparatus for assembling warps of spun fibers and/or filament yarns located on yarn beams to form a textile warp located on a warp beam which avoids the disadvantages of the known assembly systems during rapid braking discussed hereinabove.

This problem is solved with an apparatus for assembling warps of spun fibers and/or filament yarns present in yarn beams to form a textile warp located in a warp beam, in accordance with the present invention.

BRIEF DESCRIPTION OF THE DRAWINGS

Embodiments of the invention will be explained more specifically hereinbelow by reference to the drawings, in which.

DESCRIPTION OF THE PREFERRED EMBODIMENTS

Figure 1:
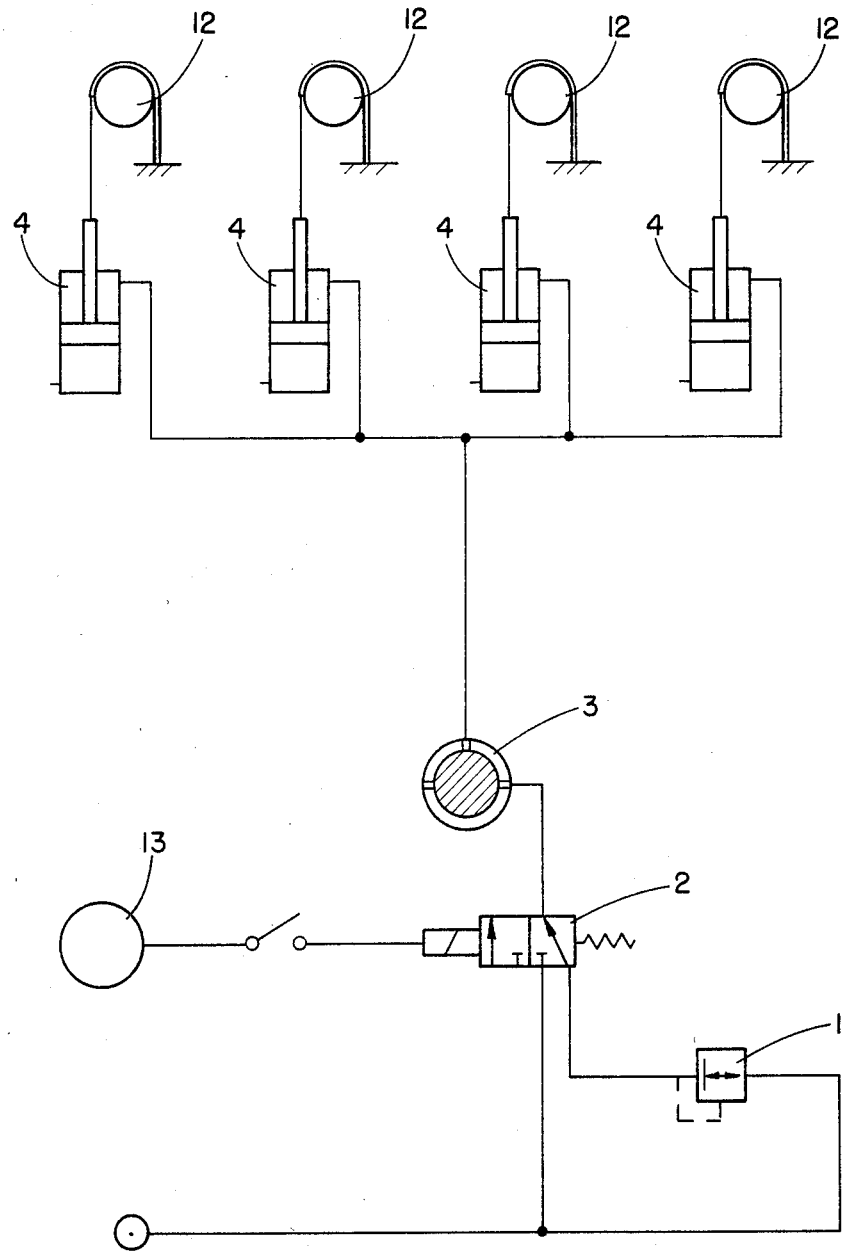
FIG. 1 shows schematically an arrangement for the pneumatic braking of the yarn beams in the known assembly systems.

According to FIG. 1, in the normal operation of the known assembly systems, compressed air is available at the mouth of the pneumatic pressure regulator 1 and at the mouth of the pneumatic valve 2. The compressed air present at the pneumatic valve 2 is available for rapid braking of the yarn beams. The compressed air available at the pneumatic pressure regulator 1 is brought by means of this pressure regulator 1 to a predetermined lower pressure set at this pressure regulator 1 and is passed through the open pneumatic valve 2 which is arranged downstream of regulator 1 to the three-position rotary disk valve 3 which is arranged downstream of the pneumatic valve 2. With the rotary disk valve 3 open, the compressed air of lower pressure reaches the brake cylinders 4 of the yarn beam brakes 12 connected in parallel which are arranged downstream of the rotary disk valve 3.

With the rotary disk valve 3 closed, the compressed air of lower pressure remains present at the mouth of the rotary disk valve 3, the position of the disk of this valve 3 being either such that the air pressure between the exit of the rotary disk valve 3 and the brake cylinders 4 is maintained or such that the air pressure between the exit of the rotary disk valve 3 and the brake cylinders 4 is reduced. A sensor 13 of any suitable known type for responding to a sensed condition of the warp or components thereof such as, for example, a thread rupture, is connected to the switch control of the pneumatic valve 2 in a known manner.

According to FIG. 1, during rapid braking of the known assembly systems, the pneumatic valve 2 is switched, by a signal from the sensor 13 upon occurrence of a sensed condition of the warp or components thereof, so that the air stream of lower pressure coming from regulator 1 is interrupted and the compressed air of higher pressure is passed through the pneumatic valve 2 to the following three-position rotary disk valve 3. When rotary disk valve 3 is in the open position, the compressed air of higher pressure immediately reaches the brake cylinders 4 of the yarn beam brakes 12, and as a result a synchronous braking of the yarn beams and of the warp beam takes place.

In most cases, however, the rotary disk valve 3 is closed on the inlet side and, therefore, needs time to come into the open position. As a result, the compressed air of higher pressure reaches the brake cylinders 4 of the yarn beam brakes 12 with a delay, so that the yarn beams and the warp beam are not braked synchronously.

Figure 2:
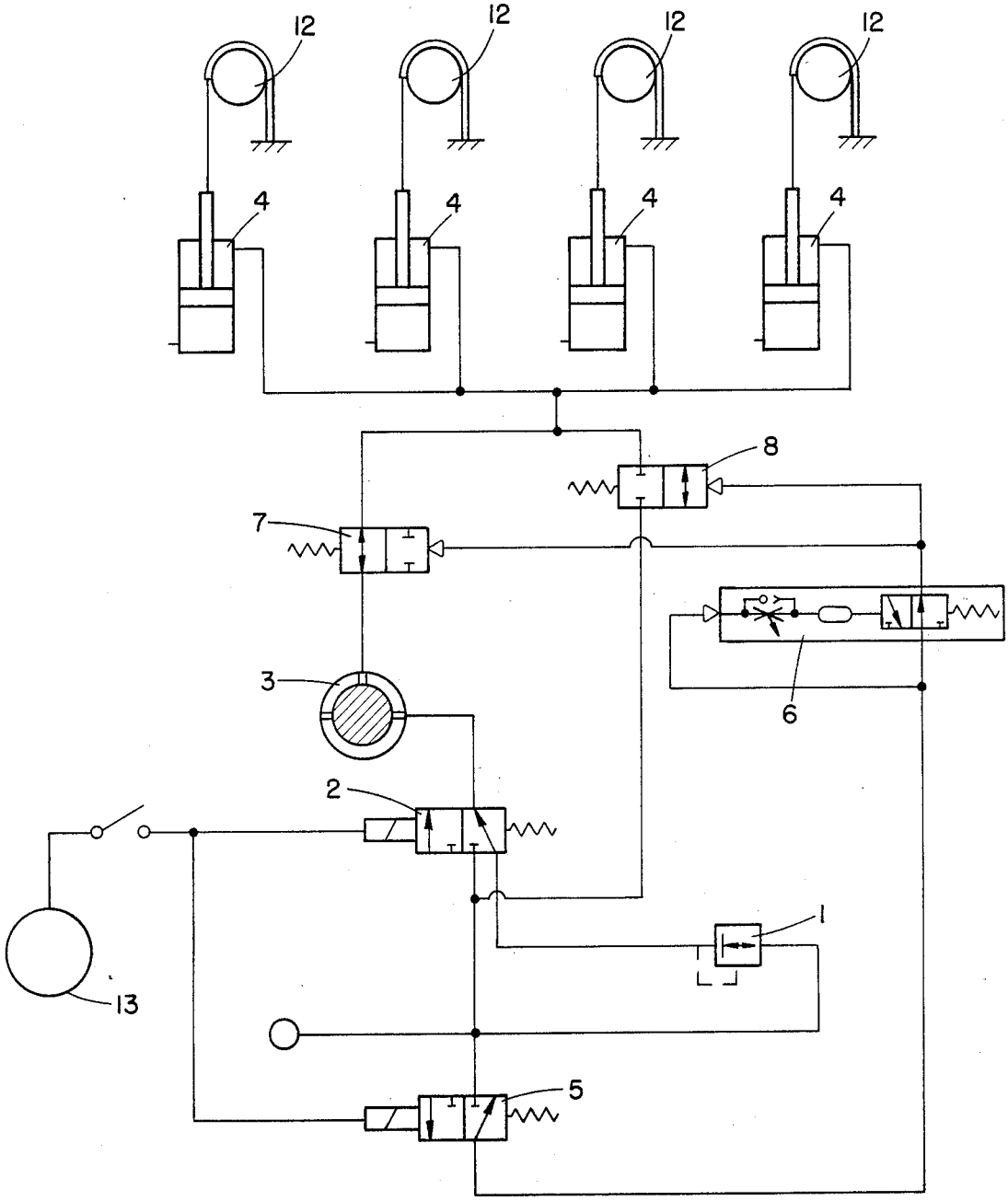
FIG. 2 shows schematically an arrangement for the pneumatic braking of yarn beams in an assembly apparatus according to the invention; this construction shows the form of realization in which the control of the pneumatic valve 6 switchable with delay and of the pneumatic valves 7 and 8 occurs pneumatically.

According to FIG. 2, in the assembly apparatus of the invention, compressed air of higher pressure is present at the entrance of the pneumatic pressure regulator 1 and at the entrance of the pneumatic valves 2, 5 and 8.

Upon rapid braking of this assembly apparatus, the pneumatic valves 2 and 5 are simultaneously switched. By the switching of pneumatic valve 2, the air stream of lower pressure coming from pneumatic pressure regulator 1 is interrupted. By the switching of pneumatic valve 5, the air stream of higher pressure reaches pneumatic valve 6 which is arranged downstream of the pneumatic valve 5 and which is switchable with delay, where this air stream of higher pressure is divided into two partial streams. One partial stream flows through pneumatic valve 6 and reaches the pneumatically operable parts of valves 7 and 8 connected in parallel and which are arranged downstream of the pneumatic valve 6, whereby these pneumatic valves 7 and 8 are switched simultaneously. By this switching of pneumatic valve 7, the air line between the three-position rotary disk valve 3 upstream of this pneumatic valve 7 and the brake cylinders 4 of the yarn beam brakes 12 following pneumatic valve 7, which are arranged in parallel, is cut off. By the switching of pneumatic valve 8, the compressed air of higher pressure, present until then at at the entrance of this pneumatic valve 8, reaches the brake cylinders 4 of the yarn beam brakes 12. The result is that the yarn beams are braked rapidly and synchronously with the warp beam.

The other partial air stream, having reached pneumatic valve 6, actuates the pneumatically-actuable part of the pneumatic delay element of pneumatic valve 6. The delay element of pneumatic valve 6 is set to a predetermined time, namely in accordance with the time which the disk of the three-position rotary disk valve 3 needs to go from the position in which the air pressure between the exit of the rotary disk valve 3 and the brake cylinders 4 is reduced, into the open position. At the end of the set delay period, the delay element of pneumatic valve 6 switches this valve 6, whereby the partial air stream flowing through pneumatic valve 6 is interrupted and the pneumatically operable parts of pneumatic valves 7 and 8 become pressureless. The pneumatic valves 7 and 8 now go back to their starting positions, that is, pneumatic valve 7 goes into open and pneumatic valve 8 into closed position. In the meantime, the compressed air of higher pressure present at first at pneumatic valve 2 has passed through the three-position rotary disk valve 3, which has switched meanwhile and gone into open position, to the entrance of the pneumatic valve which is arranged downstream of the rotary disk valve 3. Since the pneumatic valve 7 is now in open position, the compressed air of higher pressure flows through this pneumatic valve 7 to the brake cylinders 4 of the yarn beam brakes 12. According to the invention, therefore, a pneumatic by-pass limited in time, here an air by-pass, is established for bridging the switching time of the three-position rotary disk valve 3 upon rapid braking.

Figure 3:
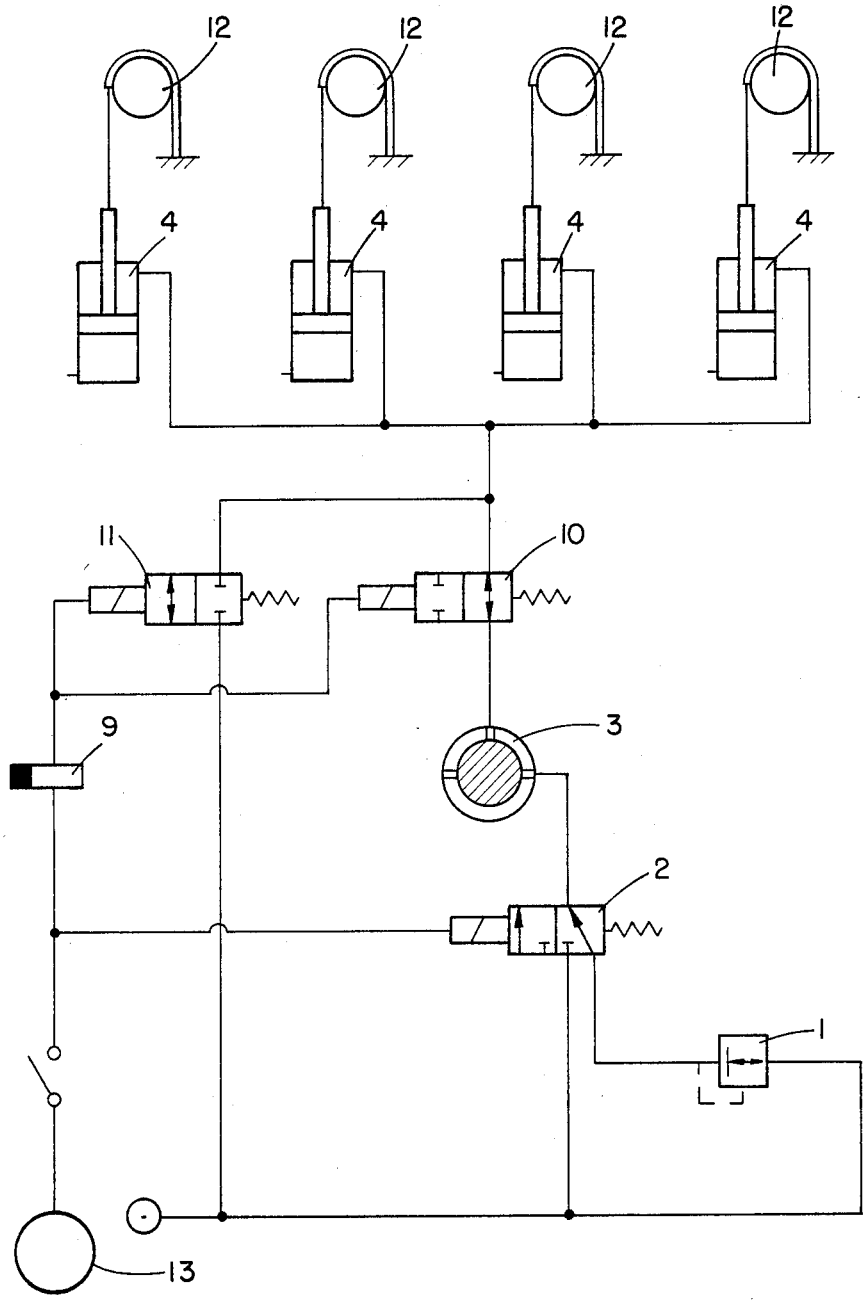
FIG. 3 shows schematically an assembly for the pneumatic braking of the yarn beams in an assembly apparatus according to the invention; this construction shows the form of realization in which the control of the electric delay element 9 and of the pneumatic valves 10 and 11 is carried out electrically.

According to FIG. 3, in the assembly apparatus of the invention, compressed air of higher pressure is present at the entrance of the pneumatic pressure regulator 1 and at the entrance of the pneumatic valves 2 and 11.

Upon rapid braking of this assembly apparatus, pneumatic valves 2, 10 and 11 are switched simultaneously. By the switching of pneumatic valve 2, the air stream of lower pressure coming from pneumatic pressure regulator 1 is interrupted. Simultaneously with the switching of pneumatic valves 2, 10 and 11, the electric delay element 9 is turned on. This electric delay element 9, also, is set to a predetermined time, namely in accordance with that named in the explanation of FIG. 2.

By the switching of pneumatic valve 10, the air line between the three-position rotary disk valve 3 upstream of the pneumatic valve 10 and the brake cylinders 4 of the yarn beam brakes 12, arranged in parallel, following the pneumatic valve 10 is cut off. By the switching of pneumatic valve 11, the compressed air of higher pressure present until then at the entrance of the pneumatic valve 11 reaches the brake cylinders 4 of the yarn beam brakes 12, whereby the yarn beams are braked rapidly and synchronously with the warp beam.

At the end of the delay period set at the electric delay element 9, the delay element 9 is switched off, whereby the electromagnet coils of the pneumatic valves 10 and 11 are de-energized. The pneumatic valves 10 and 11 now return to their starting positions, that is the pneumatic valve 10 goes into the open position and the pneumatic valve 11 into closed position. In the meantime, the compressed air of higher pressure present at first at pneumatic valve 2 has passed through the three-position rotary disk valve 3, now switched and in the open position, to the entrance of pneumatic valve 10 downstream of the rotary disk valve 3. Since the pneumatic valve 10 is now in open position, the compressed air of higher pressure flows through the pneumatic valve 10 to the brake cylinders 4 of the yarn beam brakes 12.

Here too, therefore, a pneumatic by-pass limited in time, here an air by-pass, is established to bridge the switching time of the three-position rotary disk valve 3 upon rapid braking.

The apparatus of the invention thus offers the advantage that upon rapid braking of the assembly, the yarn beams and the warp beam are braked synchronously. In this manner, one avoids the yarns striking one against another, a fact which leads to filament ruptures, and the subsequent abrupt tensioning of the yarns, which may lead to yarn ruptures.

Another advantage of the apparatus according to the invention resides in the fact that heavier yarn beams may be processed at higher speeds than with the known assembly systems.

We claim:

1. In an apparatus for assembling warps of spun fibers and/or filament yarns present on yarn beams to form a textile warp present on a warp beam, said apparatus having sensing means for responding to a sensed condition of the warp or components thereof and first control means for controlling the braking of said yarn beams upon occurrence of a sensed condition of the warp or components thereof, said first control means including a pneumatic pressure regulator (1) for providing compressed air at higher pressure, an electromagnetically operable first pneumatic valve (2) downstream of said pressure regulator, a three-position rotary disk valve (3) downstream of said pneumatic valve and brake cylinders (4) downstream of said three-position rotary disk valve, said rotary disk valve having an inlet side connected to said first pneumatic valve and being sometimes temporarily closed at its inlet side whereby compressed air at higher pressure from said pneumatic pressure regulator reaches said brake cylinders of said yarn beams with a delay, the improvement which comprises second control means having bypass means connected to said first control means and to said yarn beam brake cylinders for bridging the switching time of said rotary disk valve of said first control means thereby preventing asynchronous pneumatic braking of said yarn beams relative to said warp beam by avoiding delay in braking of said yarn beams caused by said rotary disk valve being closed at its inlet side, upon occurrence of said sensed condition of the warp or components thereof and the ensuing rapid braking, said second control means comprising a second electromagnetically operable pneumatic valve (5) arranged in parallel with said first electromagnetically operable pneumatic valve (2), a third pneumatically operable pneumatic valve (6) switchable with delay, said valve having a pneumatically operable delay element, a fourth pneumatic valve (7) downstream of said three-position rotary disk valve (3) and upstream of said brake cylinders (4), and a fifth pneumatic valve (8) connected in parallel with said first pneumatic valve (2), said three-position rotary disk valve (3) and said fourth pneumatic valve (7) and upstream of said brake cylinders (4), the pneumatically operable actuating parts of said fourth and fifth pneumatic valves (7 and 8) being connected in parallel with each other and following said pneumatically operable third pneumatic valve (6) switchable with delay; actuation of said fourth pneumatic valve cutting off the fluid flow between the rotary disc valve (3) and the brake cylinders (4) and actuation of said fifth pneumatic valve permitting air pressure to effect braking of the yarn beams, the flow to said fourth and fifth valves at the end of the delay period being switched off as the rotary disc valve (3) reaches the open position.

2. In an apparatus for assembling warps of spun fibers and/or filament yarns present on yarn beams to form a textile warp present on a warp beam, said apparatus having sensing means for responding to a sensed condition of the warp or components thereof and first control means for controlling the braking of said yarn beams upon occurrence of a sensed condition of the warp or components thereof, said first control means including a pneumatic pressure regulator (1), for providing compressed air at higher pressure, an electromagnetically operable first pneumatic valve (2) downstream of said pressure regulator, a three-position rotary disk valve (3) downstream of said pneumatic valve, yarn beam brake cylinders (4) downstream of said three position rotary disk valve and connected in parallel, said rotary disk valve having an inlet side connected to said first pneumatic valve and being sometimes temporarily closed at its inlet side whereby compressed air at higher pressure from said pneumatic pressure regulator reaches said brake cylinders of said yarn beams with a delay, the improvement which comprises second control means having bypass means connected to said first control means and to said yarn beam brake cylinders for bridging the switching time of said rotary disk valve of said first control means thereby preventing asynchronous pneumatic braking of said yarn beams relative to said warp beam by avoiding delay in braking of said yarn beams caused by said rotary disk valve being closed at its inlet side, upon occurrence of a sensed condition of the warp or components thereof and the ensuing rapid braking, said second control means comprising a second pneumatic valve (10) arranged downstream of said three-position rotary disk valve (3) and upstream of said brake cylinders (4), an electric delay element (9), and a third pneumatic valve (11) connected to said electric delay element (9) and connected in parallel with said electromagnetically operable first pneumatic valve (2), said three-position rotary disk valve (3) and said second pneumatic valve (10) and upstream of said brake cylinders (4), the electromagnetically operable actuating parts of said second and third pneumatic valves (10 and 11) being connected in parallel with each other and following said electric delay element (9); actuation of said second pneumatic valve cutting off the fluid flow between the rotary disc valve (3) and the brake cylinders (4) and actuation of said third pneumatic valve permitting air pressure to effect braking of the yarn beams, the flow to said second and third pneumatic valves at the end of the delay period being switched off as the rotary disc valve (3) reaches the open position.

3. An apparatus for assembling warps of spun fibers and/or filament yarns present on yarn beams to form a textile warp present on a warp beam, said apparatus having sensing means for responding to a sensed condition of the warp or components thereof and first control means for controlling the braking of said yarn beams upon occurrence of a sensed condition of the warp or components thereof, said first control means including a pneumatic pressure regulator (1), for providing compressed air at higher pressure, an electromagnetically operable first pneumatic valve (2) downstream of said pressure regulator, a three-position rotary disk valve (3) downstream of said pneumatic valve, and pneumatically operable yarn beam brake cylinders (4) downstream of said three-position rotary disk valve and connected in parallel, said rotary disk valve having an inlet side connected to said pneumatic valve and being sometimes temporarily closed at its inlet side whereby compressed air at higher pressure from said pneumatic pressure regulator reaches said brake cylinders of said yarn beams with a delay, the improvement which comprises second control means having bypass means connected to said first control means and to said yarn beam brake cylinders for bridging the switching time of said rotary disk valve of said first control means thereby preventing asynchronous pneumatic braking of said yarn beams relative to said warp beam by avoiding delay in braking of said yarn beams caused by said rotary disk valve being closed at its inlet side, upon occurrence of a sensed condition of the warp or components thereof and the ensuring rapid braking, said second control means comprising a second pneumatic valve (7,10) arranged downstream of said three-position rotary disk valve (3) and upstream of said brake cylinders (4), a third pneumatic valve (8,11) connected in parallel with said second pneumatic valve (7,10) and upstream of said brake cylinders (4), and a delay element (6,9) connected upstream of said second and third pneumatic valves; actuation of said second pneumatic valve cutting off the fluid flow between the rotary disc valve (3) and the brake cylinders (4) and actuation of said third pneumatic valve permitting air pressure to effect braking of the yarn beams, the flow to said second and third pneumatic valves at the end of the delay period being switched off as the rotary disc valve (3) reaches the open position.

* * * * *